United States Patent [19]

Rhee

[11] 4,190,902

[45] Mar. 4, 1980

[54] PROTECTIVE DEVICE FOR THE ELBOW, ARM, PALM AND HAND

[76] Inventor: Jhoon G. Rhee, 4068 Rosamora Ct., Arlington, Va. 22207

[21] Appl. No.: 885,029

[22] Filed: Mar. 9, 1978

[51] Int. Cl.[2] ..... A41D 13/08

[52] U.S. Cl. ..... 2/16; 128/87 R

[58] Field of Search ..... 2/16, 18, 19, 20, 158, 2/159, 161 R, 161 A, 162, 167, 168, 2, 170; 128/77, 87 R

[56] References Cited

U.S. PATENT DOCUMENTS

| | | | |
|---|---|---|---|
| 3,776,225 | 7/1971 | Lonardo | 128/87 R |
| 3,911,497 | 10/1975 | Lewis et al. | 2/16 |
| 4,062,073 | 12/1977 | Rhee | 2/16 |

*Primary Examiner*—Louis Rimrodt

*Attorney, Agent, or Firm*—James C. Wray

[57] ABSTRACT

This invention relates to a protective device adapted to protect the arm, elbow, hand and palm of a person engaging in the sport of skateboarding. The device is constructed from a resilient material, such as a plastic foam, and comprises a longitudinal member with protective portions at both ends. One end is contoured to cradle the wearer's elbow and permit movement of the arm. The other end comprises a contoured section adapted to receive the palm and hand of the wearer. Suitable fastening means are provided to hold the device on the wearer's arm, hand and palm.

10 Claims, 16 Drawing Figures

PROTECTIVE DEVICE FOR THE ELBOW, ARM, PALM AND HAND

BACKGROUND OF THE INVENTION

This invention relates to a protective device adapted to be worn on a person's elbow, arm, hand and palm when engaging in the sport of skateboarding, which has undergone an immense growth in popularity in recent years. However, in a recent survey, it was estimated that more than 100,000 various types of skateboard injuries occurred in one year with many of them attributed to children 10 to 14 years of age. In almost all cases, the injured victims had not been wearing any kind of protective equipment.

A person engaging in the sport can possibly lose his balance, slip off the skateboard, or the skateboard slips out from under the person, etc. When such happens and the person falls, the person usually attempts to break his fall by extending his arms and falls on them thereby causing injuries to the palms, hands, arms and elbows.

The present invention provides a novel protective device adapted to shield a person's palms, hands, arms and elbows from injuries when engaging in the sport of skateboarding.

SUMMARY OF THE INVENTION

It is an object of this invention to provide a novel protective unitary device for a person's hand, palm, arm and elbow to be worn while engaging in the sport of skateboarding.

Another object of this invention is to provide a novel protective device for the palm, hand, arm and elbow of a person of simplified construction, comprising a resilient energy-absorbing plastic foam which can be covered with a tough, pliable plastic material, and which is relatively inexpensive.

A further object of the invention is to provide a device for wearing on a person's arm, elbow, palm and hand which protects against injury when one falls.

Generally, the protective device comprises a longitudinal member made from a resilient material, which can comprise a tough, outer coating, preferably of energy-absorbing plastic foam material which is shaped and adapted to be worn and generally cover the arm from the elbow to the hand and palm and also including the fingers while leaving the back of the hand uncovered. Suitable means are provided for securing the device to the arm and hand.

DETAILED DESCRIPTION OF THE INVENTION

Figure 1:
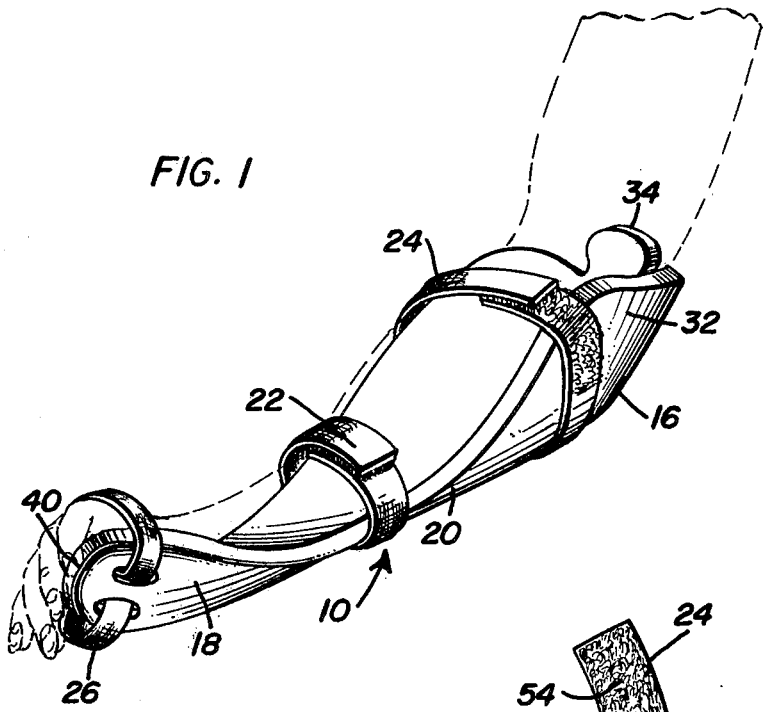
FIG. 1 is a perspective view of one embodiment of the device of the invention as worn on a person's elbow, arm, hand and palm.
Figure 2:
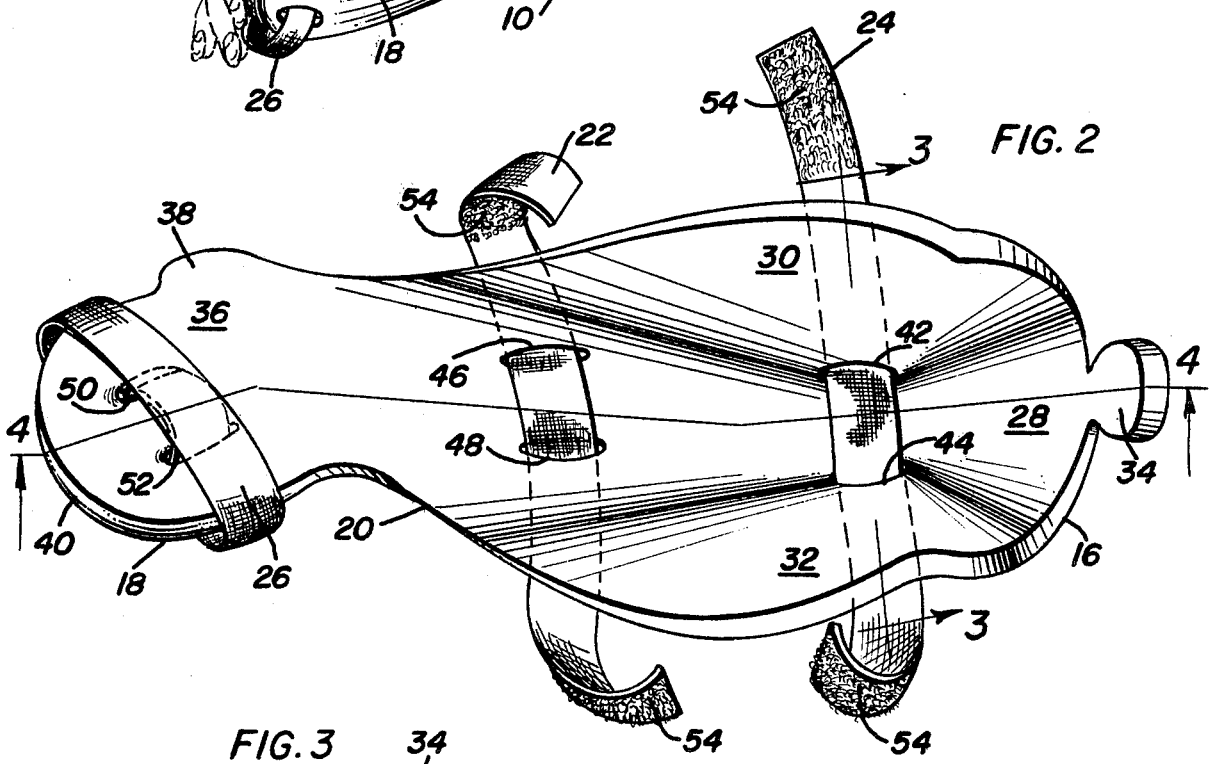
FIG. 2 is a top perspective view of the inside of the device similarly as shown in FIG. 1, but not being worn showing details thereof.
Figure 3:
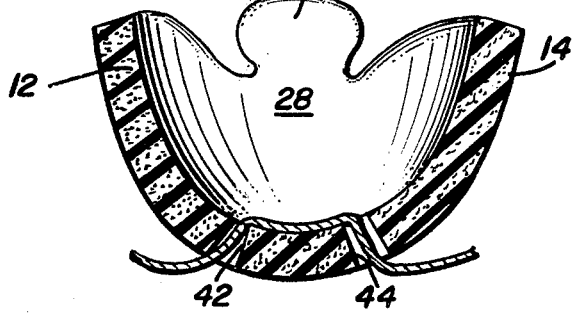
FIG. 3 is a cross-sectional view taken along line 3—3 of FIG. 2.
Figure 4:
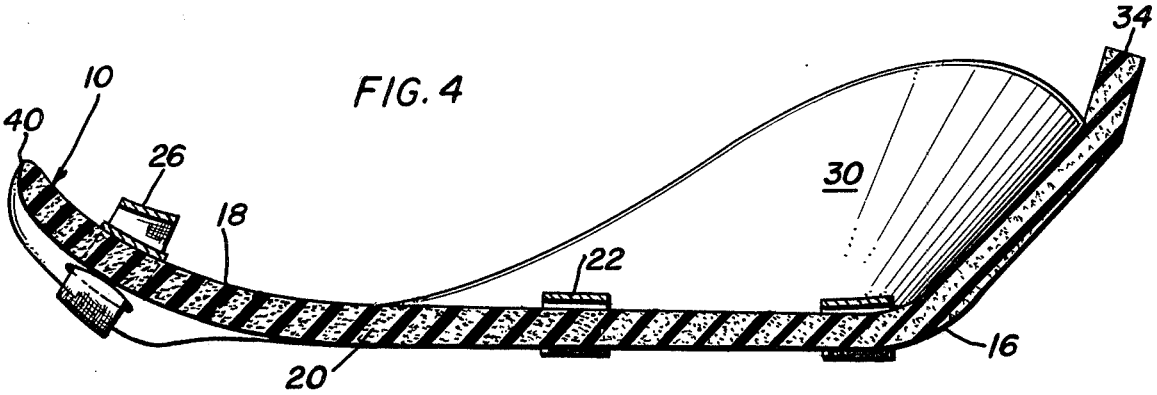
FIG. 4 is a cross-sectional view taken along line 4—4 of FIG. 2.
Figure 5:
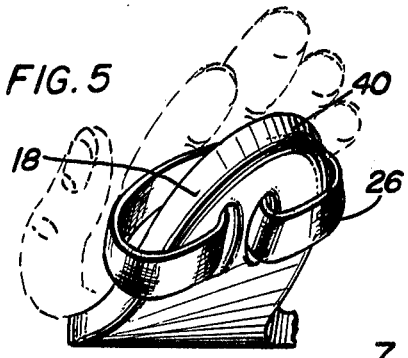
FIG. 5 is a rear perspective view of a portion of the palm of the hand showing details of how the device is worn.
Figure 6:
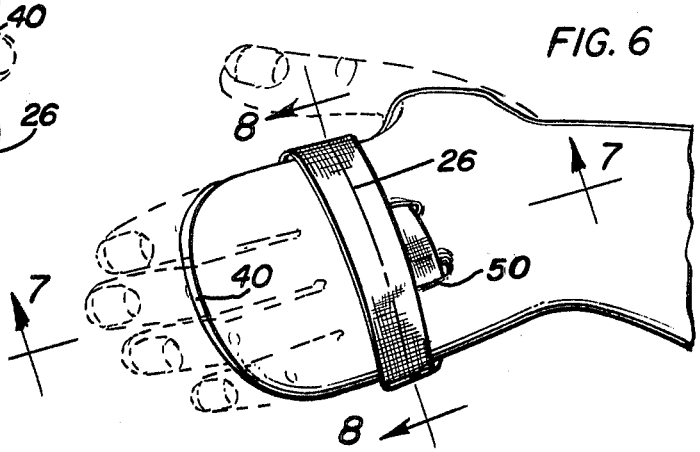
FIG. 6 is a partial perspective view of the embodiment of FIG. 1 showing how it is worn on the palm and hand.
Figure 7:
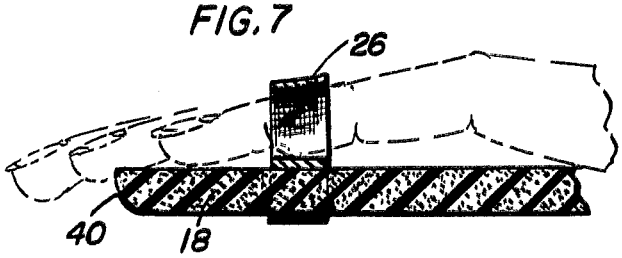
FIG. 7 is a cross-sectional view taken along line 7—7 of FIG. 6.
Figure 8:
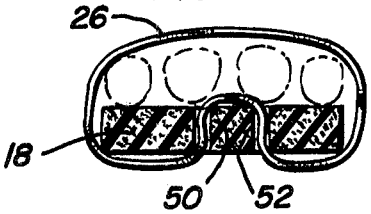
FIG. 8 is a cross-sectional view taken along line 8—8 of FIG. 6.

The first embodiment of the invention disclosed in FIGS. 1—8 in the drawings comprises a protective device generally indicated by the numeral 10. The device, preferably unitary, is formed or molded from a suitable resilient material 12 capable of absorbing energy, such as a suitable plastic material, e.g. polystyrene or polyurethane foam, rubber foam, and the like. A suitable surface coating or casing 14, preferably smooth, covers the entire resilient material 12 throughout, which is a tough, pliable, tear resistant material, preferably comprising a suitable plastic material, or the like. The casing or coating 14 can be formed during heating or molding of the resilient foam material to produce a fused coating thereon. Alternatively, the surface coating 14 can be applied on the resilient material by dipping or by applying and securing a coating of a suitable plastic material or the like. Materials of plastic are preferred for the coating since there are available on the market many tough, rugged, pliable materials such as polyvinylchloride, etc. However, it is also contemplated within the concept of the invention that suitable rugged leather or fabric materials, and the like, can be secured to the resilient material and used to cover the resilient material. The coating or casing used should provide a flexible, tough covering which is resistant to tearing or abrasion.

The device 10 is generally a longitudinal, contoured member having a contoured elbow portion 16 at one end, a flat hand and palm portion 18 at the opposite end, an intermediate arm portion 20 and fastening means 22, 24 and 26.

The elbow portion 16 is contoured to cradle the elbow and permit bending thereof comprising a rear portion 28 and side portions 30 and 32. A tab member 34 extends beyond the elbow portion and protects a portion of the upper arm as well as providing means to handle the device when it is being put on or taken off.

The intermediate arm portion 20 tapers from the relatively wider elbow portion to the hand and palm portion 18 and is relatively narrower and flat. This construction provides flexibility for movement of the wrists so the hand and palm portion can be turned in several directions normal for the hand.

The hand and palm portion 18 is angled a certain amount inward from the longitudinal axis of the device. This provides for the turning in towards the body of the hand which is a generally normal rest position therefor. An angle of about 15° to 30° is a normal amount and comfortable for the wearer of the device. The hand and palm portion 18 is gneerally shaped in the contour of the palm portion of the hand and a portion of the thumb 38. This leaves the fingers and thumb free and overlap the end 40 of the device.

Flexible straps 22, 24 and 26 are provided for retaining the device while it is being worn. Slots 42 and 44 are provided in the elbow portion and strap 24 passes through these slots. Similarly strap 22 passes through slots 46 and 48, and strap 26 passes through slots 50 and 52. Straps 22 and 24 have free ends and are provided with means for securing and adjusting them across the forearm portion of the arm by any suitable means such as a series of snaps, tieing means, etc. As shown in the drawings, the securing means comprises velcro material 54, with which the straps can be easily secured and adjusted. Strap 26 is permanently secured in slots 50 and 52 whereby the fingers are inserted and held between palm and hand portion 36 and the strap. Although, the straps are shown held to the device by passing through slots, it is understood that the straps can be secured to the device in any suitable manner. Furthermore, although two straps 22 and 24 are shown for holding the device on the forearm, it is within the scope of the invention to provide more than two straps or only one, e.g. strap 24.

The device is worn as shown in FIGS. 1, 5, 6, 7 and 8 by placing the elbow in portion 16, securing straps 22 and 24 across the forearm, and inserting the fingers palm down under strap 26. The device as worn cradles the elbow at the bottom of the portion 16 which is contoured at the side portions 30 and 32 and rear portion 28. This permits the upper part of the arm, above the elbow, to freely move or pivot within portion 16. Thus, the elbow can be flexed and either the upper arm or lower arm moved normally. Arm portion 20 permits the hand to be freely flexed at the wrist. The flat portion 18 extending beyond portion 20 and across the front of the palm and fingers is adapted to be flexible and is normally angled inwardly as described above. The fastening means 26 and portion 18 are adapted with arm and elbow to permit the fingers and thumb to be free and to perform any normal function if desired such as grasping, etc. When the hand and fingers are flexed, the protective portion 18 is also flexed along therewith.

Figure 9:
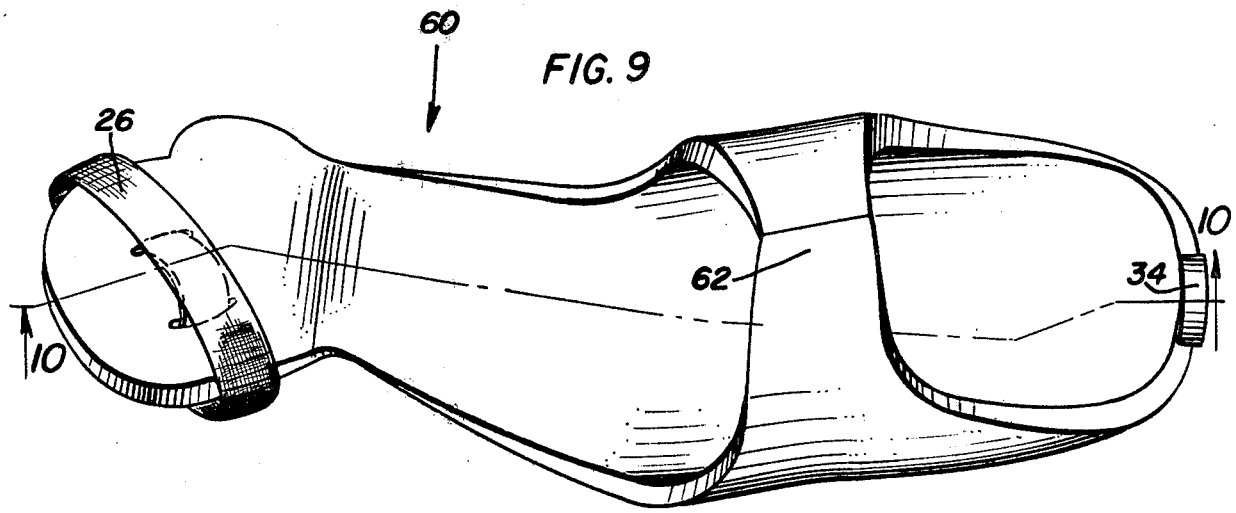
FIG. 9 is a top perspective view of a second embodiment of the protective device of the invention.
Figure 10:
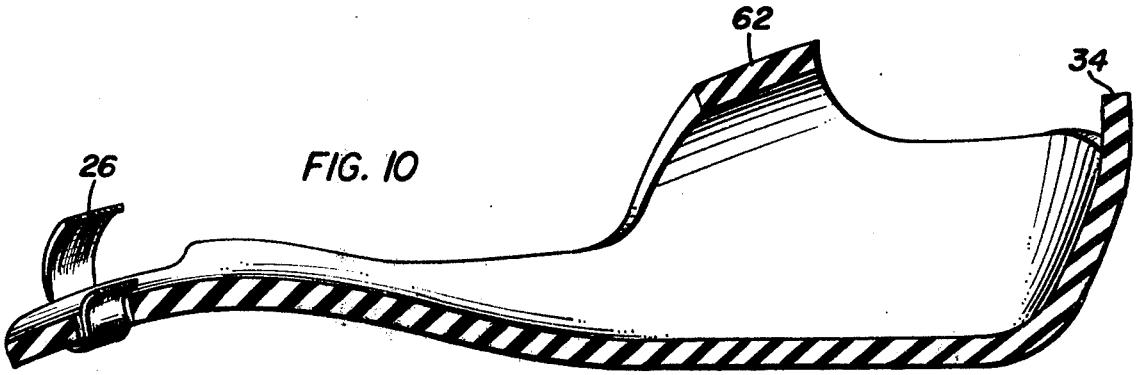
FIG. 10 is a cross-sectional view taken along line 10—10 of FIG. 9.
Figure 11:
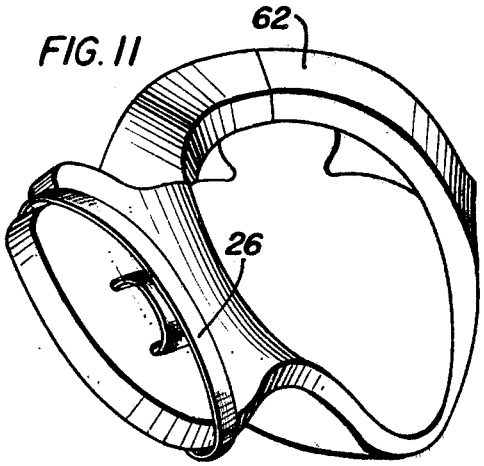
FIG. 11 is an end perspective view taken from the hand end of the embodiment of FIG. 9.
Figure 12:
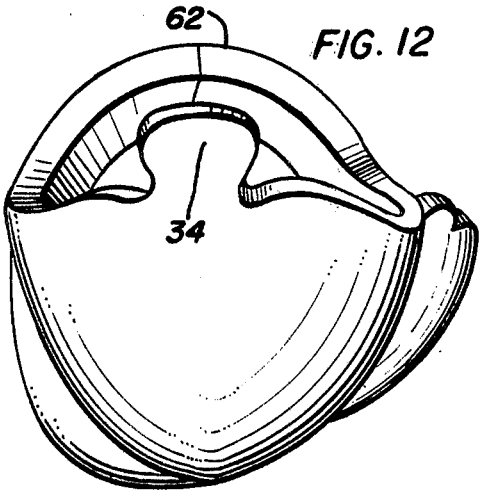
FIG. 12 is an end perspective view taken from the elbow end of the embodiment of FIG. 9.

The second embodiment of the protective device shown in FIGS. 9–12, generally denoted by the numeral 60, is substantially similar in construction as device 10. However, in this device, a tubular portion 62 is provided to retain the device on the arm in place of straps 22 and 24. Strap 26 is provided on the hand portion 18 as in device 10. With the tubular construction, the device is easier to put on and take off and also provides limited protection to the forearm.

Figure 13:
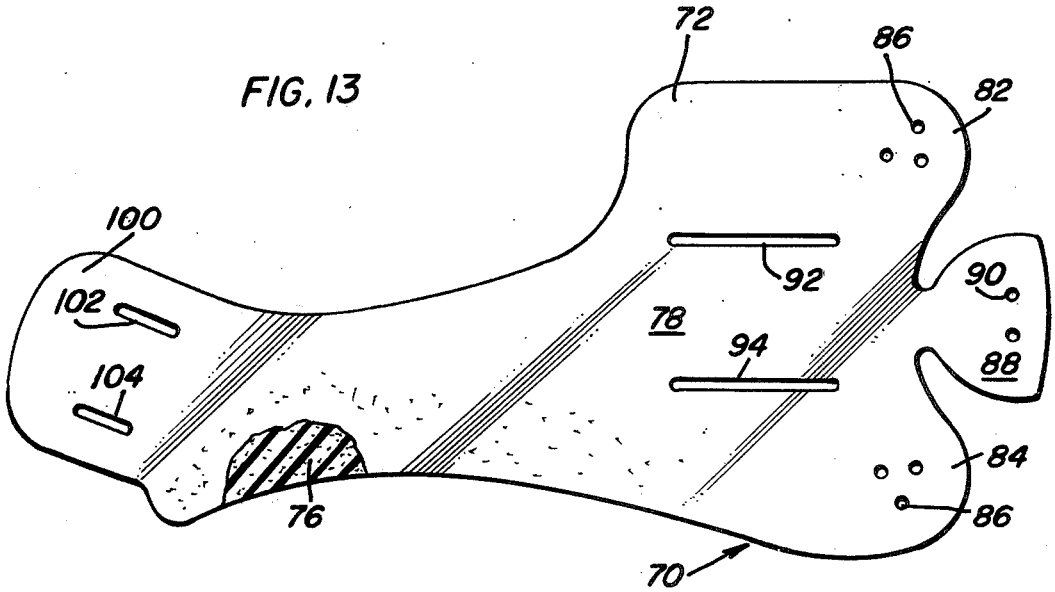
FIG. 13 is a top perspective inner view of a third embodiment of the protective device of the invention shown as a development member without securing means.
Figure 15:
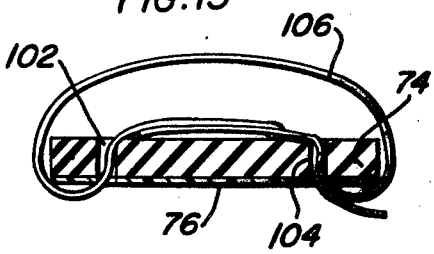
FIG. 15 is a cross-sectional view taken along line 15—15 of FIG. 14.
Figure 14:
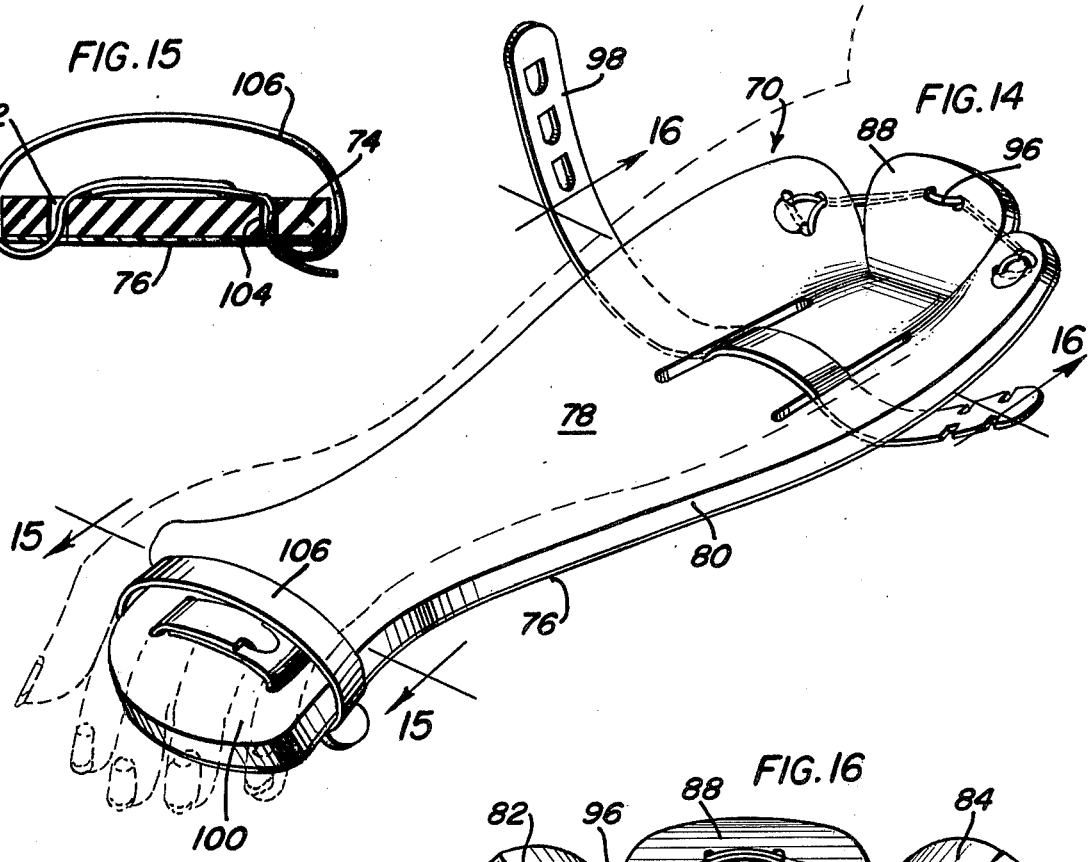
FIG. 14 is perspective inner view of the embodiment of FIG. 13 disclosing the securing means and as worn on an arm and hand shown in phantom.
Figure 16:
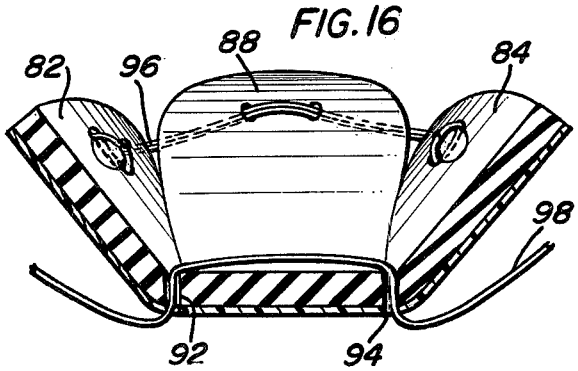
FIG. 16 is a cross-sectional view taken along line 16—16 of FIG. 14.

The third embodiment of the protective device shown in FIG. 13–16, generally denoted by the numeral 70, is somewhat similar in overall design as device 10. However, this embodiment can be formed from the flat development member 72 shown in FIG. 13 and can be produced relatively inexpensively. Member 72 comprises a resilient plastic foam material 74 with the outside surface having a suitable integral plastic coating 76. The inner surface 78 and peripheral edge 80 comprise the exposed resilient plastic foam material. There are available today, various plastic foam materials which are tear-resistant and, therefore, do not require a surface coating. For example, on the market today there are various closed cell, unicellular, plastic foam material formed of many tiny closed cells filled with a gas such as nitrogen. These materials are very light, have very good strength and high shock absorbency, and have a generally smooth surface. The materials can be used by themselves or they can be vinyl coated for additional strength by dipping, spraying or bushing. An example of these unicellular plastic materials is "ENSOLITE" (registered trademark of Uniroyal Corporation) which is a blend of nitrile rubber and polyvinylchloride.

The elbow portion of member 72 comprises side members 82 and 84 each containing three holes 86 in a triangular arrangement. A flap member 88 containing a pair of holes 90 extends rearwardly between the side members 82 and 84. Slots 92 and 94 are disposed forward of the flap member 88 in the elbow portion of the device.

The elbow portion is formed by threading a continuous elastic lace 96 through the various holes 86 and 90 and tightening and securing the lace to form a contoured elbow portion adapted to cradle the elbow of the wearer. The flap member 88 and sides 82, 84 are free to flex when the wearer's elbow and arm are moved because of the elastic lace and the resiliency of the foam material. A strap 98 is threaded through the slots 92 and 94 and retains the device on the arm and elbow of the wearer.

The hand and palm portion 100 of the device 70 is similar in design and construction as device 10 and comprises slots 102 and 104 through which a strap 106 passes to retain the hand and palm portion on the hand.

As worn and in use when skateboarding, the various embodiments of the device protect the elbow, arm, the palm of the hand and fingers against accidental falls while not restricting normal manual dexterity of the fingers or movement of the arm.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A flexible, unitarily molded, protective device for wearing on and protecting the elbow, arm, hand and palm of a person engaging in the sport of skateboarding comprising:

a. resilient means having a generally longitudinal contoured configuration adapted to extend between the elbow and palm of the wearer;

b. an elbow end comprising contoured portions adapted to cradle the person's elbow and to permit free movement of the upper part of the wearer's arm therein and to accommodate normal bending of the elbow;

c. a palm end comprising a flat portion adapted to cover the palm of the wearer's hand while permitting free movement of the fingers and thumb;

d. an intermediate narrower arm portion adapted to cover the back of the arm and to permit free movement of the wrist of the wearer;

e. securing means for retaining said device on the arm and on the hand of the wearer.

2. The device of claim 1 wherein said securing means comprise strap means across said palm end adapted to retain the hand.

3. The device of claim 1 wherein said securing means comprises strap means adapted to be secured across the forearm of the wearer.

4. The device of claim 1 wherein said securing means comprises a unitarily molded tubular member disposed at said intermediate portion.

5. The device of claim 1 wherein said palm end is angled inwardly towards the body of the wearer.

6. The device of claim 1 wherein said elbow end comprises a rearwardly extending tab member.

7. The device of claim 1 wherein said resilient means comprises a casing of a molded plastic material which covers the outer surfaces of said resilient means.

8. The device of claim 1 wherein said resilient means are plastic foam means.

9. The device of claim 1 wherein said elbow end comprises an end flap member and side members which are retained in a contoured elbow-cradleing position by an elastic lace passing through holes disposed in said flap and side members.

10. The device of claim 9 wherein said resilient means has a plastic coating on the outer surface of the device.

* * * * *